US008091460B2

(12) United States Patent
Hainze et al.

(10) Patent No.: US 8,091,460 B2
(45) Date of Patent: Jan. 10, 2012

(54) MISSILE SECURE-RELEASE MECHANISM HAVING WHEEL LOCK DETENT

(75) Inventors: Sean A. Hainze, Huntsville, AL (US); Donald E. Davis, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 155 days.

(21) Appl. No.: 12/770,413

(22) Filed: Apr. 29, 2010

(65) Prior Publication Data

US 2011/0265637 A1 Nov. 3, 2011

(51) Int. Cl.
*F41F 3/052* (2006.01)

(52) U.S. Cl. ..... 89/1.806

(58) Field of Classification Search ..... 89/1.8, 89/1.806, 1.807, 1.808
See application file for complete search history.

(56) References Cited

U.S. PATENT DOCUMENTS 3,040,629 A * 6/1962 Garnett et al. ..... 89/1.806
3,958,490 A * 5/1976 Zellmer et al. ..... 89/1.807
4,358,983 A * 11/1982 Fallon et al. ..... 89/1.806
4,870,885 A * 10/1989 Grosselin et al. ..... 89/1.819
4,922,799 A * 5/1990 Bartl et al. ..... 89/1.819
5,291,820 A * 3/1994 Hainsworth et al. ..... 89/1.806
5,533,433 A * 7/1996 Giesenberg et al. ..... 89/1.806
5,889,226 A * 3/1999 Giesenberg et al. ..... 89/1.812

FOREIGN PATENT DOCUMENTS

GB 2078912 A * 1/1982

* cited by examiner

*Primary Examiner* — Bret Hayes
(74) *Attorney, Agent, or Firm* — Michael K. Gray

(57) ABSTRACT

The invention efficiently and effectively secures and releases a rail-launched missile. An asymmetrical secure-release wheel (70) is defined by several surfaces which extend radially outward from a pivot hole (70K). The surfaces include a wheel unlatch surface (70H), a wheel notch stop surface (70D), a wheel detent surface (70G), a clockwise stop surface (70C) and a counterclockwise stop surface (70B). The wheel (70) is rotatable within a wheel housing (72). When a missile is loaded onto the launch rail, the middle shoe of the missile engages the detent surface (70G) of the wheel. During missile launch, the plume of the missile moves a trigger (110) which pulls a connecting rod (52) aft which results in a wheel lock (78) being disengaged from the detent surface (70G). A microswitch (56) provides a signal indicating whether the wheel (70) is in a latched or unlatched state.

15 Claims, 7 Drawing Sheets

MISSILE SECURE-RELEASE MECHANISM HAVING WHEEL LOCK DETENT

DEDICATORY CLAUSE

The invention described herein may be manufactured, used and licensed by or for the U.S. Government for governmental purposes without payment of any royalties thereon.

BACKGROUND OF THE INVENTION

1. Field of the Invention

The present invention pertains to mechanisms and systems for retaining and releasing a missile on a rail launch system.

2. Discussion of the Background

In order to assure accuracy of a missile launcher, it is desirable for a missile launcher to provide a smooth release and induce a minimum of impulse back into the launching platform of an air launched missile. Prior to the fielding of the Army HYDRA 70 Lightweight Launchers, M260 and M261, for the 2.75 Inch Rocket System, the retention mechanisms for tactical launchers fell into three categories.

The first approach was called a material failure detent. For systems that employ this approach, the munition is restrained by a material component that was designed to fail (i.e. break) when the launch motor thrust became higher than the material strength of the detent. Release force is well controlled in this detent mechanism, but the detent is not reusable. The TOW Missile System is an example of this prior art.

The second approach is the spring-friction-override detent. For this approach, the munition is retained by a spring-loaded engagement retainer, a.k.a. the detent. The detent has some angle on the engaging surface, or face. As thrust builds up, the munition overcomes friction of the munition against the engaging surface of the detent. This forces the detent out of the way by overcoming the spring force that holds the retainer in place. Older 2.75 Inch launchers, such as the M158 and the M200 are examples of this prior art. Hellfire missile launchers M272, M279, and M299, such as shown in FIG. 1, are examples of this prior art. The release force is poorly controlled, but the launcher may be used multiple times.

The third approach may be termed the umbilical-pull detent. This is the most complicated detent/retention system. For this approach, the missile is retained in its launch tube by the communication and power plug, commonly called the umbilical. At the moment that the external launch command is transmitted to the missile, the missile thermal batteries are energized. When the missile completes pre-launch checkout, a fire pulse is sent to an explosive squib adjacent to the umbilical. When the squib is fired, the umbilical is retracted.

When the retracted umbilical reaches the end of its motion, a switch is closed and the rocket motor igniter receives a firing pulse over the last external connection to the missile. The missile then is launched out of its tube. During the brief time between umbilical retraction and motor ignition, the missile is held in place by a light spring-friction-detent. The Stinger Surface-to-Air missile is an example of this prior art. This type of detent mechanism is a one-time use only system.

The newest detent approach is called the blast-actuated detent. This approach was developed for the HYDRA 70 M260 and M261 launchers and these launchers are examples of this prior art, shown in FIG. 2. One of the goals of that design was to minimize impulse into the launcher platform during the firing of the rockets. A description of its operation is associated with Prior Art FIG. 2.

FIG. 1 depicts the prior art detent mechanism currently used in the M272, M279, and M299 Hellfire missile launchers. This prior art is the spring-friction-override detent. The detent mechanism is protected from the environment by the detent cover 16. To load a missile, the sides of the middle and aft missile rail shoes are engaged in the grooves 12A on the inside of the missile launcher rail 12. The missile slides aft until the middle shoe on the missile is almost at the detent 10. The handle 24 that is attached to the detent raising cam 14 is rotated counter-clockwise. Rotating the detent raising cam 14 causes the detent 10 to rotate about the detent retainer pivot shaft 18.

As the detent engagement surface 10A is raised, the detent spring 22 is compressed. The handle 24 is held in position while the missile is pushed aft until the middle shoe firmly rests against the aft missile stop 20. The handle 24 is then rotated clockwise and returned to its original position. The detent raising cam 14 also returns to its original position. The detent 10 has engaged the middle shoe of the missile.

The combination of friction between the missile middle shoe, and detent 10 and the spring constant of the detent spring 22 determines the missile release force.

When a Hellfire missile is to be launched, the missile motor is fired. As thrust builds up, the middle shoe pushes against the detent engagement surface 10A of the detent 10. Aided by the angle on the detent engagement surface 10A, the detent 10 rotates clockwise about detent retainer pivot shaft 18. As the detent 10 is forced up, the detent spring 22 is compressed down. When the detent 10 is clear of the missile middle shoe, the missile will then move along the launch rail 12 until the middle and aft shoes drop clear of the rail.

FIG. 2 depicts the prior art detent mechanism currently used in the M260 and M261 varieties of the 2.75 inch diameter Hydra 70 rocket launchers. The detent mechanism holds rockets in the launch tube 26 between the time that the rocket is loaded into the launch tube 26 and the moment the rocket motor is fired. The blast-activated detent mechanism is contained within the detent housing 44. The detent housing 44 is held on the launch tube 26 with strips of aluminum spot welded to the launch tube 26.

When a rocket is loaded, the blast paddle 30 is rotated counter-clockwise about the blast paddle pivot pin 34. As the blast paddle 30 rotates, the blast paddle cam surface 30A rubs on the aft portion of the side contact 40, which is wrapped around the end of the detent housing 44. The side contact 40 is held in place on the detent housing 44 by two rivets 28. The action of rotating the blast paddle 30 pulls the sear 38 in the aft direction against the sear spring 36. The motion of the sear 38 causes the detent 42 to pivot about the detent pivot point 42B. The aft portion of the detent 42 is forced down while the forward end moves up in the vertical plane.

The detent 42 is forced against the detent springs 46. The detent pivot point 42B is a rectangular hole in the retainer plate 49. The retainer plate 49 is held in the detent housing 44 by six rivets 48. The aft motion of the sear 38 removes downward force from the forward end of the side contact 40 causing the contacts to retract out of the launch tube 26. This clears the way for a rocket to be loaded. The blast paddle 30 is rotated until it passes an over center position, which locks the detent 42 into position for loading a rocket.

When a rocket is loaded, it is pushed into the launch tube, 26 until it is in contact with the aft stops 32. To lock the rocket in the launch tube 26, the blast paddle 30 is rotated clockwise about the blast paddle pivot pin 34 so that it will protrude into the aft opening of the launch tube 26. The action causes the sear 38 to move forward, forcing the contact points of the side contact 40 into the rocket contact band. The detent 42 is allowed to pivot about the detent pivot point 42B until the detent engagement groove 42A of the detent 42 engages the detent ring on the rocket nozzle. The detent springs 46 hold the detent 42 in position while it has engaged the rocket nozzle.

Launching the rocket consists of a process that is the opposite of loading the launcher. When the rocket motor receives an electrical firing pulse through the side contact 40, the rocket motor igniter fires and sends hot gases to light the motor grain. The hot gases also exit the rocket nozzle and put an unbalanced gas pressure on the blast paddle 30. The unbalanced pressure causes the blast paddle 30 to rotate counterclockwise about the blast paddle pivot pin 34, with the blast paddle cam surface 30A sliding over the rub surface of the side contact 40. As the blast paddle 30 rotates, it pulls the sear 38 aft, compressing the sear spring 36.

The motion of the sear 38 allows the side contact 40 to withdraw from the rocket contact band groove. The motion of the sear 38 also causes the detent 42 to rotate about the detent pivot point 42B in the retainer plate 49 and out of the launch tube 26. This disengages detent engagement groove 42A of the detent 42 from the detent ring on the rocket nozzle. The action of the detent 42 compresses the detent springs 46. As the thrust of the rocket motor builds up, the rocket is free to slide down the launch tube 26 only being restrained by friction.

SUMMARY OF THE INVENTION

The secure-release mechanism of the present invention is used in conjunction with a launch rail such as a missile launch rail provided on a helicopter or aircraft. The secure-release mechanism includes a connecting rod which is connected to and positioned between a wheel assembly and a trigger assembly. The trigger assembly and the wheel assembly are secured to the launch rail with the launch rail having an aperture to allow access to the middle shoe of a missile.

The trigger assembly includes a trigger housing. A trigger rod extends through the trigger housing and connects to a trigger positioned at the rear or aft of the trigger housing. The trigger rod connects to the connecting rod at a first end of the connecting rod. A spring stop is positioned at a location proximate to where the trigger rod connects to the first end of the connecting rod. A trigger spring is positioned and secured between the spring stop and the trigger housing.

The wheel assembly includes a wheel housing which engages a wheel slider at a forward section of the wheel housing such that the wheel slider can slide, i.e., is slidable, within the wheel housing. A secure-release wheel is rotatable upon a pivot pin supported by the wheel slider, with the pivot pin being inserted through a pivot hole in the secure-release wheel. The wheel housing is provided with a bushing at the rear end of the wheel housing. A raceway is positioned in a middle section of the wheel housing between the forward section and rear of the wheel housing.

A wheel lock is in sliding engagement with the raceway of the wheel housing. The wheel lock has a microswitch engagement pin positioned at a lateral side thereof. The rear of the wheel lock is secured to a lock link. The lock link extends through a bushing in the rear of the wheel housing and connects to the second end of the connecting rod.

The secure-release wheel is asymmetrical and has a plurality of defined surfaces located radially outward from the pivot hole. A wheel unlatch surface of the secure-release wheel contacts the wheel lock when the secure-release wheel is in an unlocked position. A wheel notch leading edge is located between the wheel unlatch surface and a lock surface. A wheel notch stop surface adjacent to the lock surface serves as a stop to the forward axial movement of the wheel lock. A wheel latch leading edge is the leading edge of the secure-release wheel which first contacts the middle missile shoe when a missile is loaded on the launch rail. A wheel detent surface of the secure-release wheel secures the middle shoe of a missile so as to lock the missile in place on the launch rail. The secure-release wheel is further provided with a clockwise stop surface and a counterclockwise stop surface.

A slider pin supported by the wheel slider is positioned between the clockwise stop surface and the counterclockwise stop surface to limit the clockwise and counterclockwise rotation of the secure-release wheel.

A wheel assembly spring has a first end connected to a spring securing aperture located on a protruding flange portion of the secure-release wheel. The wheel assembly spring has a second end which connects to a spring securing aperture located in a flange positioned above the bushing in the aft of the wheel housing.

A pair of release springs are compressed between the front end of the wheel slider and a wheel stop. A pair of shoulder screws, which extend through the wheel stop, the release springs and the front of the wheel slider, are screwed into the wheel housing.

A flange provided on a lateral side of the wheel housing is used to mount a microswitch. The microswitch is provided with a bent leaf actuator. When a missile is loaded onto the launch rail, the trigger is placed is a latched position which causes the connected rod to move forward such that the lock link and wheel lock are moved forward such that the front section of the wheel lock fits into the wheel notch stop surface of the secure-release wheel. When a missile is launched the connected rod is pulled to the rear and the microswitch pin presses against the bent leaf actuator which presses the contact of the microswitch which sends a signal that the secure-release mechanism of the present invention is in the unlatched state.

The present invention is able to retain the load along the missile's axis and provides a blast-enabled detent release of the missile from a launch rail while greatly reducing the energy input into the launcher and the airframe of an aircraft.

The wheel assembly of the present invention automatically secures a missile as it is loaded on to a launch rail. The wheel assembly includes an asymmetrical secure-release wheel having a plurality of defined surfaces which are positioned radially outward from a pivot hole through which a pivot pin extends. A microswitch which is mechanically connected to the wheel assembly notifies launcher electronics if the detent surface of the wheel assembly is in a latched or unlatched state.

Upon firing the missile, the exhaust blast from the missile motor hits the trigger, causing the trigger to rotate counterclockwise out of the propellant plume. This rotational motion is transferred to lateral motion in the connecting rod by the action of the cam surface on the trigger. The connecting rod pulls the lock backward out of the wheel, allowing the wheel to rotate freely, thus releasing the missile to travel freely down the launch rail. When the connecting rod is pulled back, the lock link is disengaged from the secure-release wheel thereby allowing the microswitch pin to contact the microswitch. When the pin-microswitch connection is made, launcher electronics are able to determine an unlatched state.

The present invention is robust enough to withstand the retention force imparted by the missile along the launch axis. This force is roughly equivalent to a 6G retention capacity for the Hellfire missile under all conditions except for during launching of the missile.

The present invention may also act as a spring-override detent. The missile may push the secure-release wheel forward off of the wheel lock should any event occur such that the trigger fails to release the secure-release wheel. The secure-release wheel is mounted upon a wheel slider connected to release springs such that when the missile pushes upon the secure-release wheel, the wheel slider moves forward and away from the wheel lock, compressing two compression springs, and allowing the secure-release wheel to rotate.

An additional design feature of the present invention is that the mechanism automatically locks when a missile is loaded onto the launch rail. When the missile slides down the rail towards the loaded position, the missile contacts the wheel and causes the wheel to rotate around until the lock can slide into position. The spring in the trigger assembly forces the connecting rod and lock into a notch in the wheel, preventing the wheel from rotating.

When the lock is in position in the wheel, a pin no longer contacts the microswitch causing the switch to be open. The launcher electronics are able to determine that the secure-release mechanism is in the latched state.

Also, the trigger of the trigger assembly is able to rotate 180 degrees such that the trigger can be pointed up. This allows the secure-release mechanism to be placed flat on a horizontal surface for storage while protecting the trigger from damage.

DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENT

Reference is now made to the drawings wherein like numbers represent like parts in each of the several figures.

Figure 3:
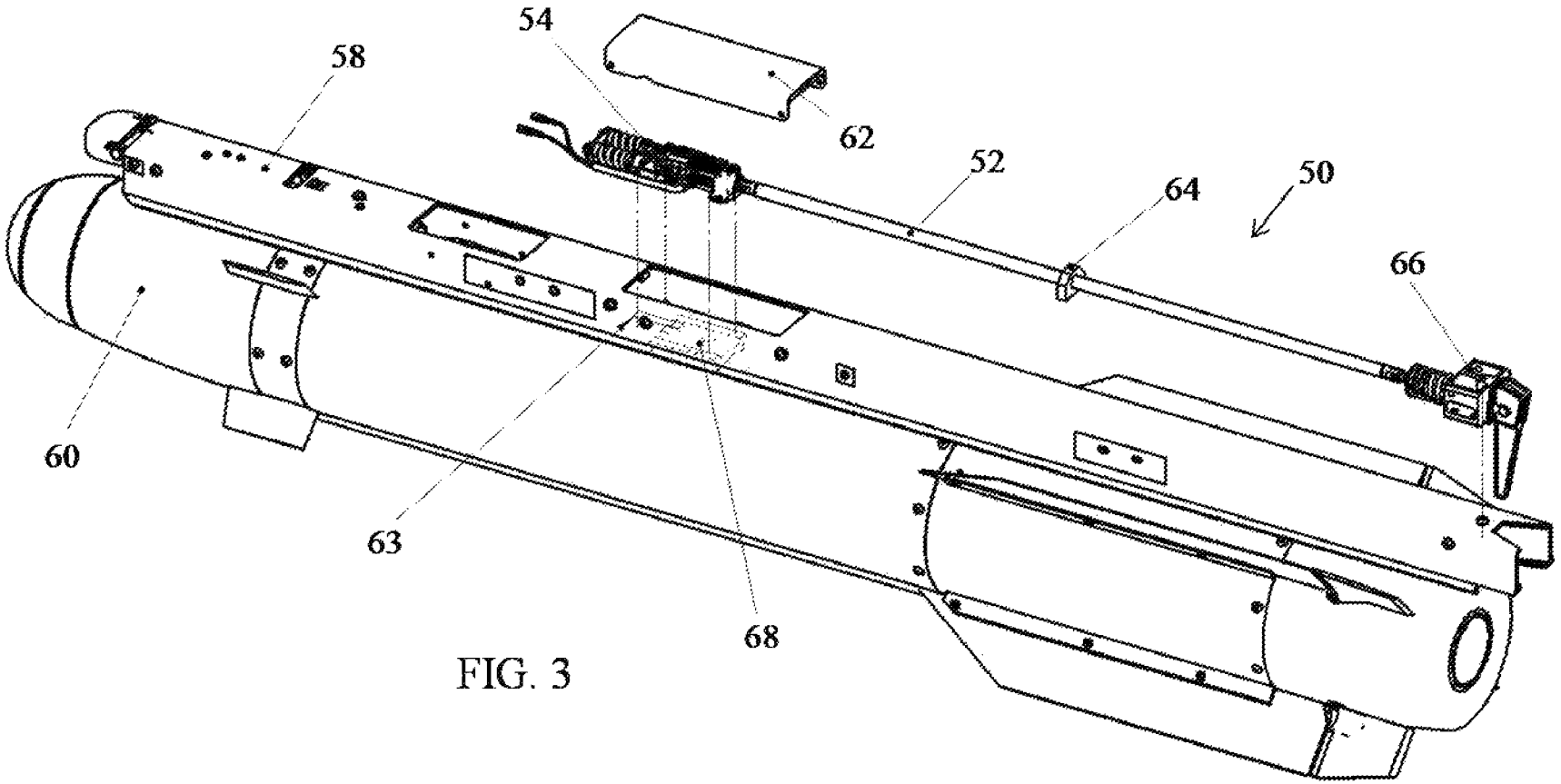
FIG. 3 is a partially exploded, perspective view showing the orientation of the missile secure-release assembly of the present invention in relation to a launch rail and missile.

In FIG. 3, a securing-releasing mechanism 50 is provided with a trigger assembly 66 and a wheel assembly 54 which are connected by connecting rod 52. The trigger assembly 66 and the wheel assembly 54 are secured to the launch rail 58. The connecting rod 52 is held in position above the launch rail 58 by lubricated rod guide 64. The wheel assembly 54 is protected from the environment by a cover 62. When missile 60 is loaded onto the rail 58, the wheel assembly 54 securely retains the missile 60 on the rail 58 until the missile is launched.

Figure 4:
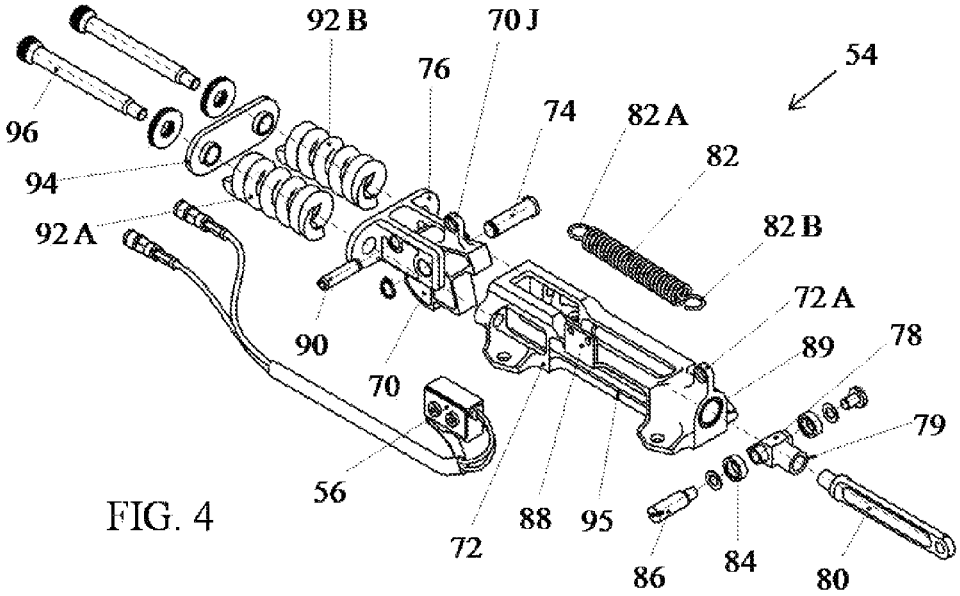
FIG. 4 is an exploded view of the wheel assembly section of the present invention.

In FIG. 4, a secure-release wheel 70 is mounted to wheel slider 76 by wheel pivot pin 74. The slider pin 90 is inserted into the wheel slider 76 such that the rotational position of the wheel 70 is limited in either rotational direction by slider pin 90. The wheel slider 76 is inserted into the forward end of the wheel housing 72.

Safety release springs 92A, 92B are compressed onto the wheel slider 76 by the wheel stop 94, so as to hold the wheel slider 76 firmly in place in the wheel housing 72. The wheel housing 72 is provided with a flange 88 for mounting microswitch 56. The wheel stop 94 is mounted and secured to the wheel housing 72, through holes in the wheel slider 76, by shoulder screws 96A, 96B. The compressive force on the safety release springs 92 is determined by the number of washers used underneath the shoulder screws 96A, 96B that mount the wheel stop 94. Launch rail 58 contains an aperture 63 (FIG. 3) which allows secure-release wheel 70 to make contact with missile middle shoe 68. Secure-release wheel 70 is latchable to the middle shoe 68 of missile 60.

A first end 82A of wheel extension spring 82 is attached to the wheel 70 at wheel spring mount 70J. A second end 82B of spring 82 is attached to spring mount 72A of wheel housing 72. Spring 82 provides the force that pushes the wheel 70 into the unlatched position prior to a missile being load on the launch rail. Wheel lock 78 mounts inside the raceway in the wheel housing 72 and fits into the like-shaped notch in the wheel 70. The lock bearings 84 are attached on both sides of the wheel lock 78 and roll along the raceway 95 in the wheel housing 72.

The microswitch pin 86 is attached to the wheel lock 78 and acts upon the microswitch 56 as the wheel lock 78 moves fore and aft. The wheel lock 78 is connected to lock link 80, which attaches to the rear 79 of the wheel lock 78 while fitting through the bushing 89 in the wheel housing 72. The missile launcher electronics are able to determine that the detent is in the unlatched state.

Figure 5:
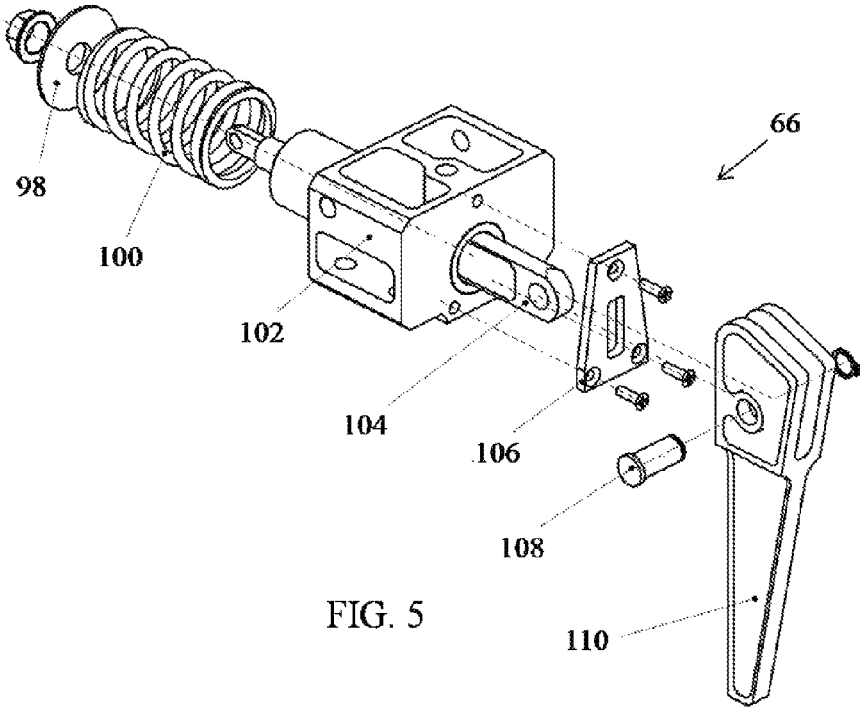
FIG. 5 is an exploded view of the trigger assembly section of the present invention.

With reference to FIG. 5, the trigger 110 is mounted to the aft end of the trigger rod 104 by the trigger pivot pin 108. The trigger rod 104 is held in position by mounting through the bushing in the trigger housing 102 and through the slot in the trigger plate 106. The trigger spring 100 mounts against the trigger housing 102 and pushes upon the spring stop 98. The spring stop is mounted securely to the forward end of the trigger rod 104. The compressive force on the trigger spring 100 is determined by the geometry of the assembled parts and the position of the trigger 110 on the trigger plate 106. The action of the trigger spring 100 keeps the trigger 110 pushed firmly against the trigger plate 106 under all rotational positions.

Figure 6:
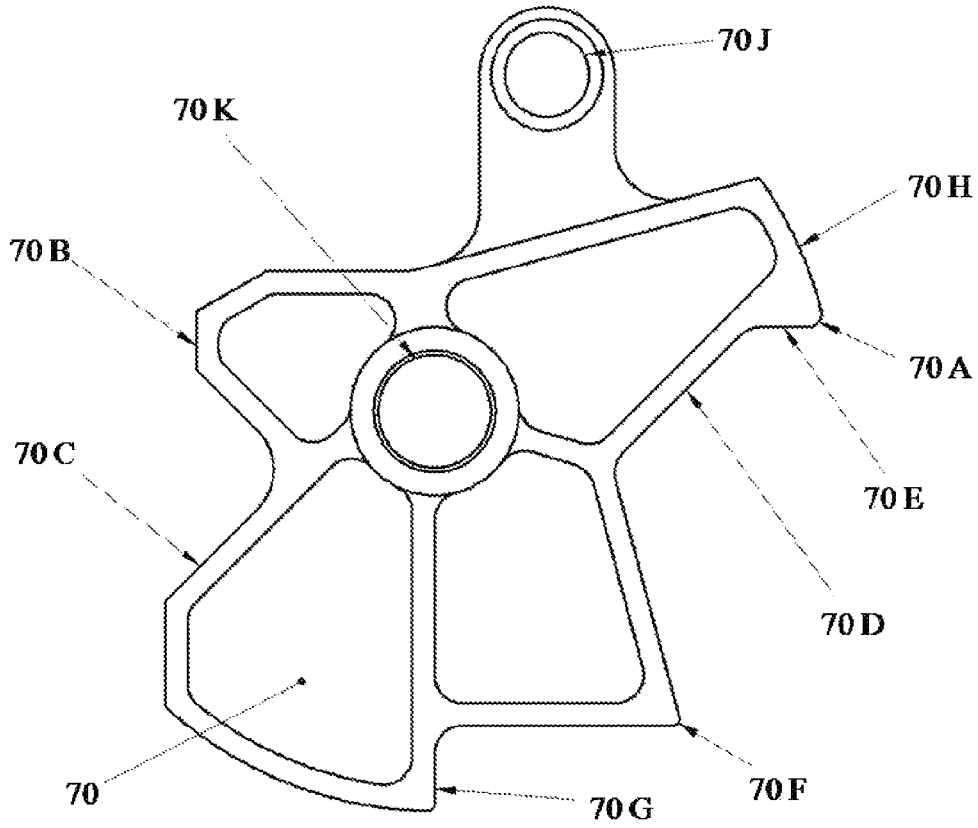
FIG. 6 is a side-view of the secure-release wheel of the present invention.

As demonstrated in FIG. 6, the wheel 70 has many surfaces which interact with other parts in the wheel assembly 54. The wheel notch leading edge 70A slides against the wheel lock 78 as the wheel 70 rotates. The rotation of the wheel is restricted between the counter-clockwise stop surface 70B and the clockwise stop surface 70C when they contact the slider pin 90. The wheel notch stop surface 70D stops the forward axial movement of wheel lock 78. The wheel notch lock surface 70E rests against the wheel lock 78 when the secure-release mechanism 50 of the present invention is in the latched position. The wheel latch leading edge 70F contacts the missile middle shoe 68 when loading the missile 60. The wheel detent surface 70G contacts the missile middle shoe 68 when the missile 60 has been loaded onto the rail 58. The wheel un-latched surface 70H contacts the wheel lock 78 when the detent is in the unlatched position. The wheel spring mount 70J attaches the wheel extension spring 82 to the wheel. The wheel pivot hole 70K is where the wheel pivot pin 74 slides through, mounting the wheel 70 to the wheel slider 76.

Figure 7:
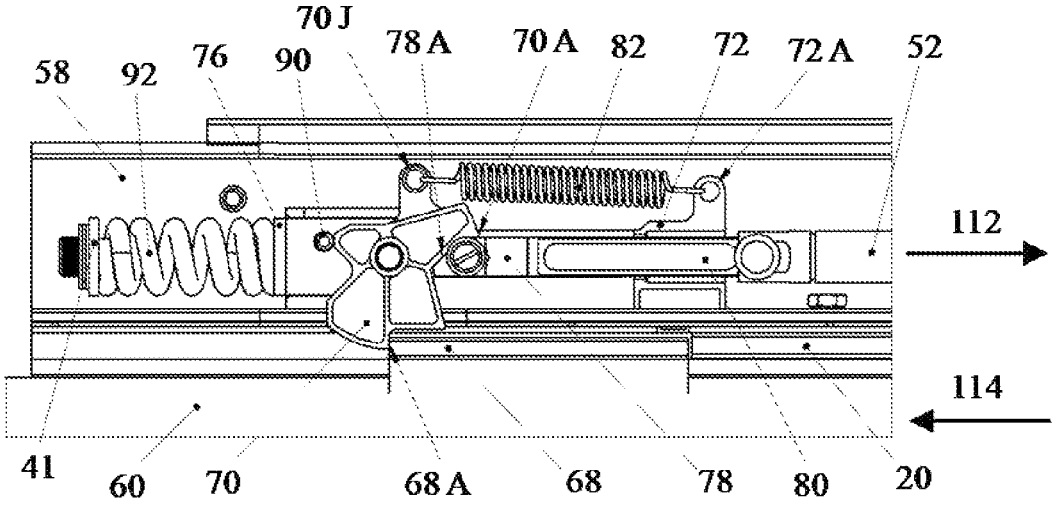
FIG. 7 is a sectional side-view of the wheel assembly section of the present invention with the microswitch removed.

With respect to FIG. 7, before the missile 60 is fired, the wheel 70 holds the missile 60 on the launch rail by capturing the missile middle shoe 68 between the wheel detent surface 70G and the rail missile stops 20. The missile middle shoe 68 is kept firmly pushed against the wheel detent surface 70G by the interaction of the missile 60 and the springs on the connectors which electrically join the missile to the launcher electronics. The wheel 70 is prevented from rotating counter-clockwise by the slider pin 90.

When the missile 60 is fired, the forward thrust 114 of the missile 60 pushes the missile middle shoe 68 of the missile 60 against the wheel detent surface 70G of the wheel 70. This force acts to force the wheel 70 to rotate clockwise. As the wheel notch lock surface 70E contacts the wheel lock 78, it puts a normal force against the wheel lock 78, preventing the wheel 70 from rotating.

At the same time, through the interaction of the trigger assembly 66 and the missile motor plume, the connecting rod 104 is pulled in the aft direction 112. The force pulling the connecting rod 104 from the trigger assembly 66 must overcome the friction force holding the wheel lock 78 in place under the notch in the wheel 70 against the wheel notch lock surface 70E. To mitigate this friction force, the wheel lock has bearings 84 on either side to roll in the raceway of the wheel housing 72.

Upon ignition of the missile motor, the rocket exhaust gases, i.e., the rocket plume, cause unbalanced forces through the trigger assembly 66 and impart enough force to pull the connecting rod 104 and overcome the friction force holding the wheel lock 78 in place. This pulls the wheel lock 78 out from under the wheel 70, allowing the wheel 70 to rotate clockwise. The wheel extension spring 82 also acts to rotate the wheel 70 clockwise.

Once wheel notch leading edge 70A contacts the front section 78F of the wheel lock 78, the rotational force on the wheel 70 imparted by the missile 60 acts to push the wheel lock 78 and connecting rod 52 aft.

After the wheel lock 78 has moved sufficiently aft, the wheel 70 is completely free to rotate out of the way of the mid rail shoe of the missile 60. The wheel 70 will rotate clockwise until it again contacts the slider pin 90. At this point, the wheel 70 is now in the ready-to-load position.

Figure 1:
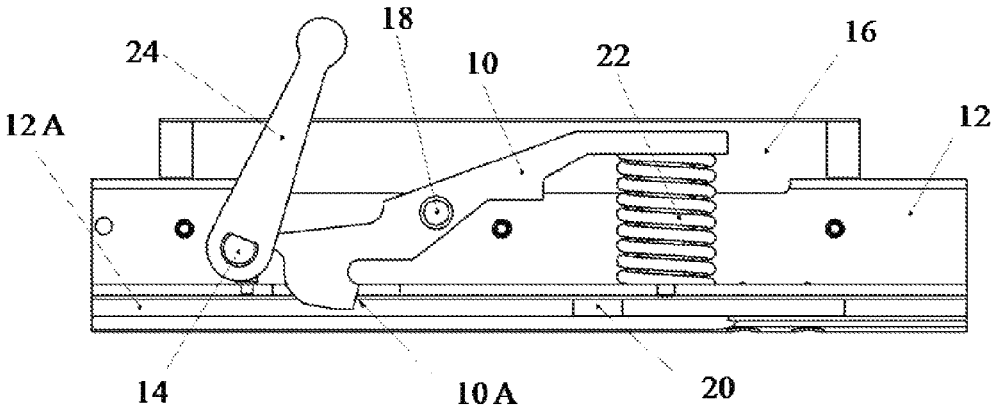
FIG. 1 (Prior Art)
FIG. 1 is a sectional side view of a prior art HYDRA 70 rocket launcher blast-activated detent mechanism.
Figure 2:
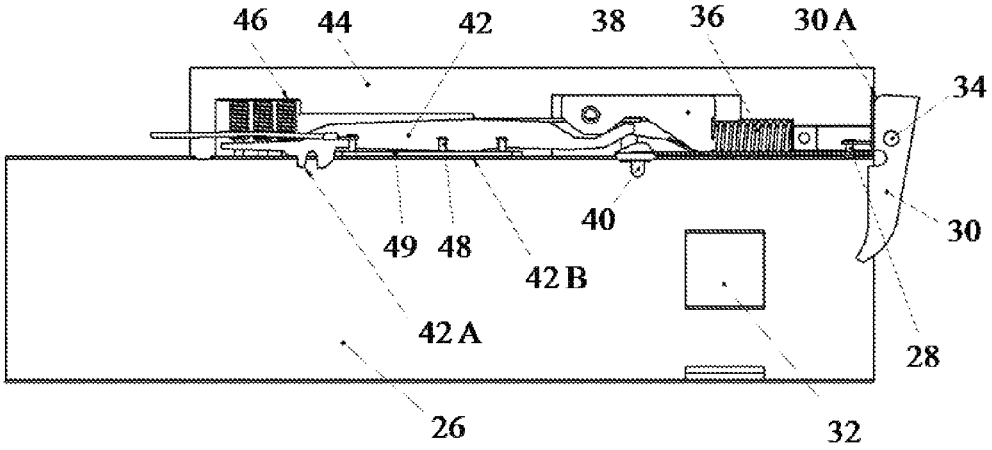
FIG. 2 (Prior Art)
FIG. 2 is sectional side view of a prior art Hellfire missile launcher spring-override detent mechanism.

The entire process from missile firing to release of the wheel 70 to freely rotate happens in the first 10-20 milliseconds after ignition of the missile motor. The missile 60 is released faster than the force of the missile motor can ramp up, and much faster than the current spring-override detent in the missile rail, shown in FIG. 2. By significantly reducing the time the detent holds the missile on the rail after launch, the total energy put into the launcher from the missile is significantly reduced. This reduces the total displacement of the launcher during the launch process. The overall effect is to greatly reduce the chance of an errant missile after launch. On certain aircraft, an errant missile can be caused by interaction of the missile 60 and the rail 58 after the missile 60 leaves the rail 58 as the launcher springs back to its initial position before launch.

Should some circumstance occur where the trigger assembly 66 fails to pull the connecting rod 52 and the wheel lock 78 out from under the wheel 70, the present invention can still function as a spring-override detent mechanism. The wheel 70, being mounted to the wheel slider 76, can move horizontally forward inside the wheel housing 72 if enough force is applied to overcome the compressive force of the safety release springs 92A, 92B. The safety release springs 92A, 92B are pre-loaded to approximately 200 lbs of compression each.

After the missile thrust ramps up to at least 720 lbs of thrust, the missile 60 will force the wheel 70 forward off of the wheel lock 78. During assembly of the wheel assembly 106, the spring-override function of the present invention is tested and adjusted such that the force required to release the missile 60 under thrust will be within 630 lbs and 700 lbs of force along the missile thrust vector. This is done by adjusting the number of washers under the shoulder screws 96 that locate the position of the wheel stop 94 relative to the wheel housing 72.

When the wheel 70 and wheel slider 76 slide forward against the safety release springs 92A, 92B far enough, the wheel notch leading edge 70A in the wheel 70 contacts the sloped surface of the wheel lock 78A. The rotational force on the wheel 70 imparted by the missile 60 acts to push the wheel lock 78 and connecting rod 104 aft. Alternately, should the wheel lock be unable to move, the wheel 70 can continue to move forward relative to the wheel housing 70. This will also allow the wheel 70 to rotate far enough clockwise to allow the missile 60 to depart the rail 58. While the spring-override function provides no benefit over the current spring-override detent, shown in FIG. 2, with respect to the total energy imparted into the launcher during launch, it does greatly reduce the probability of a hangfire event occurring due a failure in the detent mechanism.

Figure 8:
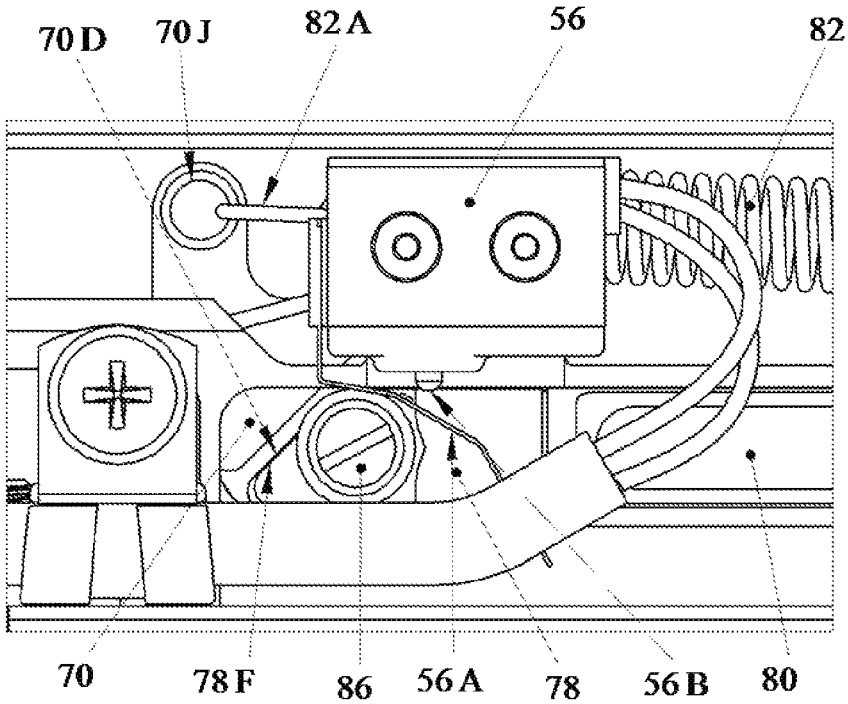
FIG. 8 is a sectional side-view showing the microswitch in relation to the microswitch pin and secure-release wheel of the present invention in a latched state.

Referring now to FIG. 8, the secure-release mechanism is in a latched state; thus, the microswitch 56 is positioned such that the bent leaf actuator 56A does not make contact with the microswitch contact 56B. When the detent surface 70G is in the latched position, the microswitch pin 86 does not contact the bent leaf actuator 56A.

Figure 15:
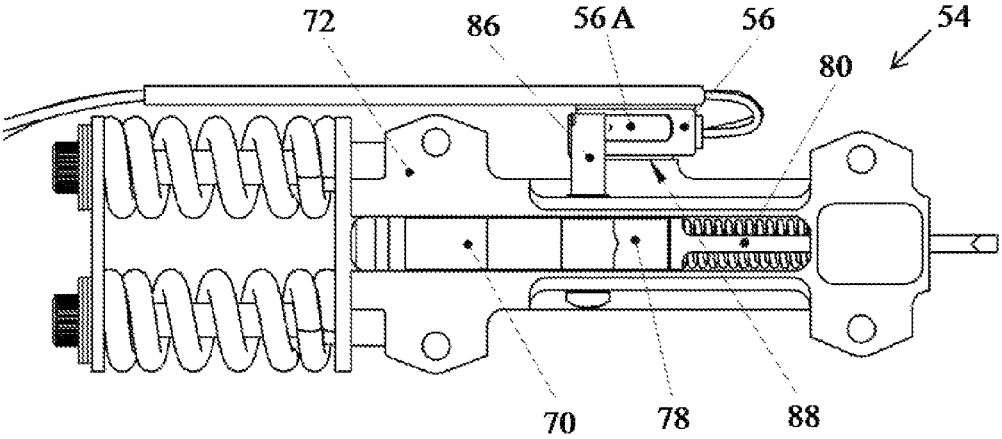
FIG. 15 is a bottom view of the wheel assembly and microswitch when the secure-release mechanism of the present invention is in a latched state.

However, during the launch of a missile 60, the wheel lock 78 is pulled aft and away from under the wheel 70. The microswitch pin 86 is attached to the wheel lock 78. As the microswitch pin 86 moves aft, it contacts the bent leaf actuator 56A. When the wheel notch leading edge 70A in the wheel 70 is approximately 70% of the way down the sloped front surface 78F of the wheel lock 78, the bent leaf actuator 56A will contact and depress the microswitch contact 56B. With the microswitch 56 activated, the launcher electronics knows that the secure-release mechanism is in the unlatched state. Through the maximum aft displacement of the wheel lock 78, the microswitch pin 86 keeps the microswitch 56 activated. The microswitch contact 56B is only released when the wheel lock 78 approaches the latched position after loading a missile 60 on the rail 58, (see FIGS. 8 and 15).

Figure 9:
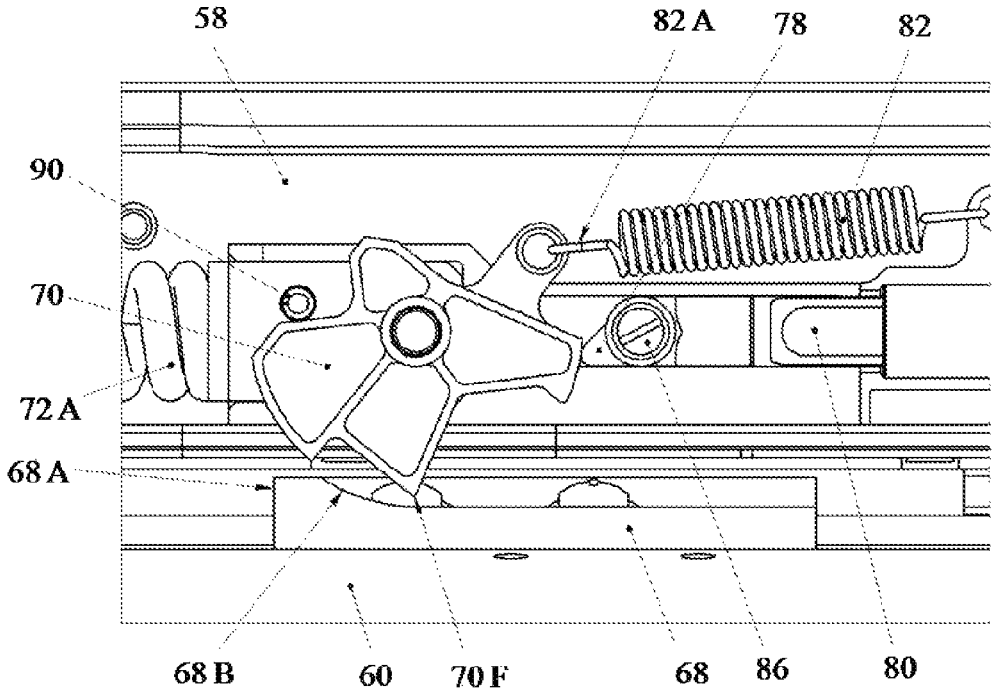
FIG. 9 is a close-up, sectional side-view schematic drawing of the wheel assembly section of the present invention with the microswitch removed and demonstrates the secure-release wheel latching to a missile shoe as the missile is loaded on the launch rail.

As demonstrated in FIG. 9, when the missile 60 is loaded onto the rail 58, the missile middle shoe 68 engages with the wheel 70 and automatically latches the detent. When the trigger assembly 66 is in the ready-to-latch state, the trigger compression spring 100 applies force through the connecting rod 104 to the wheel lock 78. The wheel lock 78 rests against the wheel unlatched surface 70H of the wheel 70, keeping the trigger 110 hanging down loosely from the trigger assembly 66. The wheel extension spring 82 holds the wheel 70 firmly against the slider pin 90, putting the present invention into the ready-to-latch state.

As the missile 60 is loaded onto the rail 58, the missile middle shoe 68 slides down slots in the rail 12A until the missile middle shoe latch surface 68B contacts the wheel latch leading edge 70F on the wheel 70. As the missile 60 slides aft, the missile middle shoe 68 causes the wheel 70 to rotate counter-clockwise until the wheel lock 78 is able to slide into place in the notch in the wheel 70.

The trigger compression spring 100 in the trigger assembly 66 forces the wheel lock 78 to seat firmly and remain in the wheel notch which causes the trigger 110 to snap tightly against the trigger plate 106 in the trigger assembly 66. This causes a loud banging sound that gives an auditory indication that latching has occurred. The missile middle shoe detent surface 68A is now in contact with the wheel detent surface 70G. At this point the missile 60 is fully retained by the wheel assembly 54.

Figure 10:
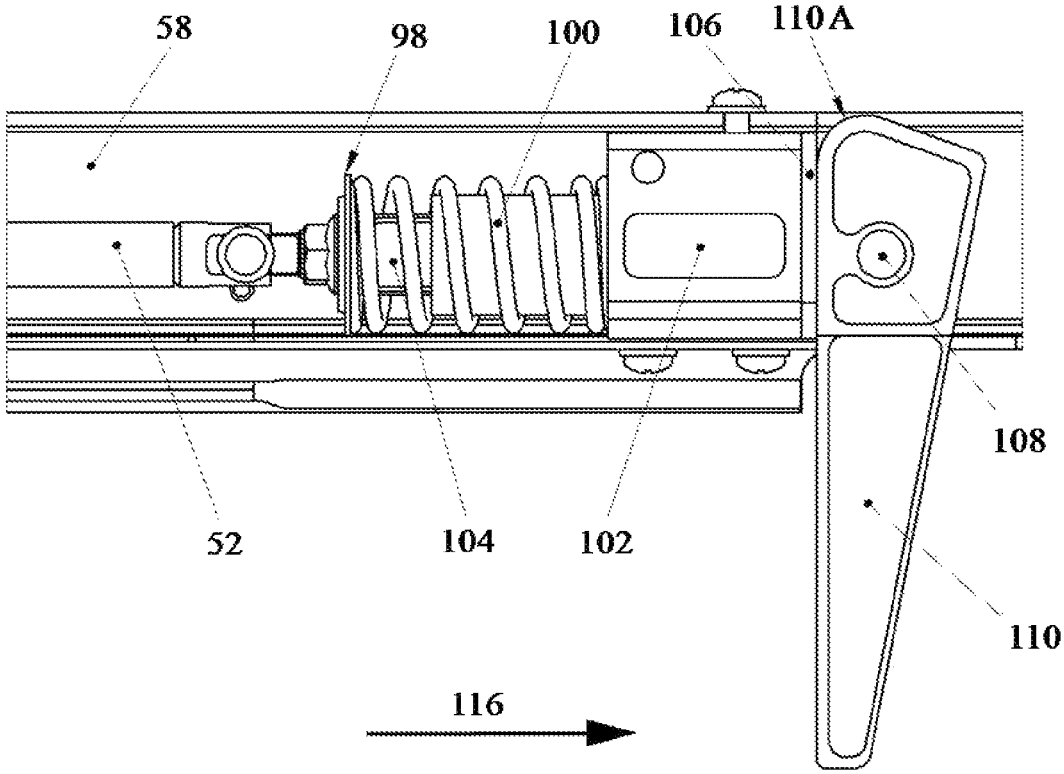
FIG. 10 is a sectional side-view schematic drawing of the trigger assembly of the present invention demonstrating the trigger being acted upon by the blast of the missile so as to move connecting rod 52 aft.
Figure 11:
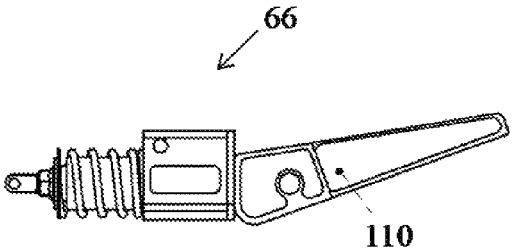
FIG. 11 is a side-view, schematic drawing of the trigger assembly 66 of the present invention in an unlatched position.

With reference to FIG. 10, when the missile 60 is loaded on the launch rail 58, the nozzle of the motor section of the missile 60 sits about 1 inch from the forward face of the trigger 110. This is the latched position for the trigger 110. When the missile 60 ignites, the missile motor plume exits the nozzle and creates a partial pressure force 116 on the trigger 110 in the direction of the motor section exhaust. This force causes the trigger 110 to rotate counter-clockwise around the trigger pivot pin 108. The cam surface on the trigger 110A contacts the trigger plate 106 and causes the trigger rod 104 to move aft as the trigger 110 rotates counter-clockwise. The trigger compression spring 100 keeps the trigger 110 tight against the trigger plate 106 throughout the rotation around the trigger pivot pin 108. The fore and aft motion of the trigger rod 104, by way of the connecting rod 104, causes the wheel lock 78 to pull out of and push back into the wheel 70.

Figure 14:
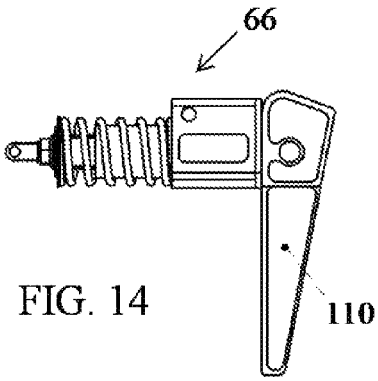
FIG. 14 is a side-view, schematic drawing of the trigger assembly 66 in the ready-to-load position.
Figure 13:
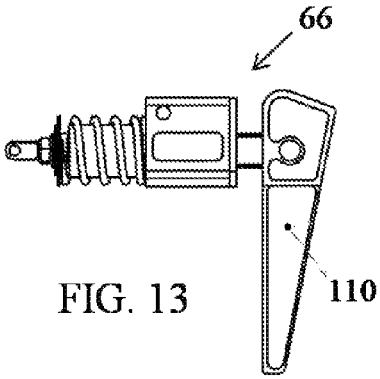
FIG. 13 is a side-view, schematic drawing of the trigger assembly 66 of the present invention in the latched position.

Referring now to FIGS. 11-14 and FIG. 5, the trigger 110 has four primary positions. As shown in FIG. 14, with the trigger 110 tight against the trigger plate 106 and hanging down vertically from the trigger pivot pin 108, the trigger 110 is in the latched position. As the trigger 110 rotates counter-clockwise towards horizontal, it trigger cam surface creates an over-center displacement of the trigger rod 104.

Figure 12:
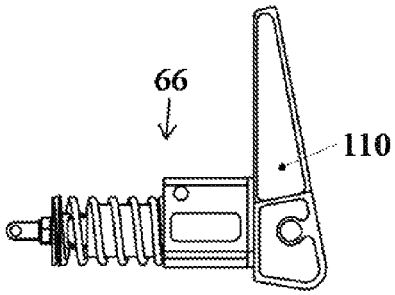
FIG. 12 is a side-view, schematic drawing of the trigger assembly 66 of the present invention in the stowed position.

By the time the trigger 110 becomes horizontal, the trigger compression spring 100 will push the trigger rod 104 back forward and keep the trigger 110 tight against the trigger plate 106. By way of FIG. 11, this is the unlatched position. If the trigger 110 is rotated further around counter-clockwise, it will pass another over-center position and come to rest tight against the trigger plate 106 with the trigger 110 sitting vertically upwards from the trigger pivot pin 108. As seen in FIG. 12, this is the stowed position.

From the unlatched position, if the trigger 110 is rotated clockwise, the trigger rod 104 will push the wheel lock 78 against the wheel 70 in the un-notched area of the wheel 70. This will cause the trigger 110 to hang down vertically, as in the latched position, but not tight against the trigger plate 106. As demonstrated in FIG. 13, this is the ready-to-latch position.

The trigger 110 is prevented from rotating clockwise from the latched position by mechanical interference between the trigger 110 and the trigger rod 104. The trigger is prevented from rotating counter-clockwise from the stowed position more than 20 degrees by the trigger stop 98 contacting the trigger housing 102. The trigger rod is prevented from sliding aft more than 0.625 inches by the trigger stop 98 contacting the trigger housing 102.

In that the blast-enabled secure-release mechanism embodied by the present invention has a much reduced energy impulse applied to the launcher from the missile during a launch event, the probability of an errant missile phenomena is greatly reduced by the present invention. Further, as the present invention encompasses automatic latching when loading a missile, the ease of operation of the missile launcher has been significantly enhanced.

By utilizing a stowed position for the trigger, the ease of the launcher to be stored has not been negatively impacted by the present invention. Additionally, the present invention meets or exceeds all the same performance requirements of prior art Hellfire rail detent mechanisms while keeping the probability of a hangfire event extremely remote.

It is understood that modifications to the present invention may be made by those skilled in the art without departing from spirit of the foregoing disclosure and the scope of the following claims.

What is claimed is:

1. A secure-release mechanism (50) for a missile to be launched from a launch rail, said secure-release mechanism being attached to the launch rail and comprising:

a wheel housing (72);

a wheel slider (76) secured within said wheel housing;

a secure-release wheel (70) rotatable on a pivot pin (74), said pivot pin being mounted on said wheel slider and extending through a pivot hole (70K) of said secure-release wheel (70);

a wheel lock (78) slidably engaged within a raceway (95) of said wheel housing;

a lock link (80) connected to a rear end (79) of said wheel lock and extending through a bushing (89) of said wheel housing;

a trigger assembly (66);

a connecting rod (52) positioned between and connected to said lock link (80) and said trigger assembly (66); and wherein said secure-release wheel (70) is asymmetrical and defined by a plurality of surfaces which extend radially outward from said pivot hole (70K), said plurality of surfaces including a wheel unlatch surface (70H), a wheel notch stop surface (70D), a wheel detent surface (70G), a clockwise stop surface (70C) and a counter-clockwise stop surface (70B).

2. A secure-release mechanism according to claim 1, further comprising:

a slider pin (90) mounted on said wheel slider (76), said slider pin limiting the clockwise and counterclockwise rotation of said secure-release wheel (70), said slider pin being positioned in the rotational path of said counter-clockwise stop surface (70B) and said clockwise stop surface (70C).

3. A secure-release mechanism according to claim 2, wherein:

said wheel lock (78) has a front section (78F) which engages said wheel notch stop surface (70D) of said secure-release wheel (70) when said secure-release wheel (70) is in a latched state.

4. A secure-release mechanism according to claim 3, wherein:

when said secure-release wheel (70) is in a latched state, said wheel detent surface (70G) is engaged with a missile shoe (68) of the missile.

5. A secure-release mechanism according to claim 4, further comprising:

a wheel spring (82) connected to said secure-release wheel (70) and said wheel housing (72).

6. A secure-release mechanism according to claim 4, further comprising:

a microswitch (56) connected to said wheel housing (72).

7. A secure-release mechanism according to claim 2, wherein:

when said secure-release wheel (70) is in an unlatched state, said wheel unlatch surface (70H) engages said wheel lock (78).

8. A secure-release mechanism according to claim 7, further comprising:

a microswitch (56) connected to said wheel housing (72).

9. A secure-release mechanism according to claim 8, further comprising:

a microswitch pin (86) connected to said wheel lock (78), said microswitch pin pressing against an actuator (56A) which presses against a microswitch contact (56B) on said microswitch (56) when said secure-release wheel (70) is in an unlatched state.

10. A secure-release mechanism according to claim 9, wherein:

said actuator (56A) is a bent leaf actuator.

11. A secure-release mechanism according to claim 2, wherein:

said trigger assembly includes a trigger (110), said connecting rod (52) connecting to a trigger rod (104) connected to said trigger.

12. A secure-release mechanism according to claim 11, wherein:

when the plume of the missile impacts said trigger (110), said trigger pulls said trigger rod and said connecting rod aft causing said lock link (80) and said wheel lock (78) to move aft.

13. A secure-release mechanism according to claim 11, wherein:

said trigger assembly (66) includes a trigger housing (102) through which said trigger rod (104) is inserted.

14. A secure-release mechanism according to claim 13, wherein:

said trigger assembly (66) includes a spring stop (98) and a trigger spring (100), said trigger spring (100) contacting and being located between said spring stop (98) and said trigger housing (102).

15. A secure-release mechanism according to claim 2, further comprising:

a wheel stop (94);

a pair of release springs (92A, 92B) secured to and located between said wheel slider (76) and said wheel stop (94).

* * * * *